US011473774B2

(12) United States Patent
Karkow et al.

(10) Patent No.: US 11,473,774 B2
(45) Date of Patent: Oct. 18, 2022

(54) METHODS OF UPGRADING A CONVENTIONAL COMBUSTION SYSTEM TO INCLUDE A PERFORATED FLAME HOLDER

(71) Applicant: CLEARSIGN COMBUSTION CORPORATION, Seattle, WA (US)

(72) Inventors: Douglas Wayne Karkow, Des Moines, WA (US); Joseph Colannino, Bellevue, WA (US); Christopher A. Wiklof, Everett, WA (US)

(73) Assignee: CLEARSIGN TECHNOLOGIES CORPORATION, Seattle, WA (US)

( * ) Notice: Subject to any disclaimer, the term of this patent is extended or adjusted under 35 U.S.C. 154(b) by 559 days.

(21) Appl. No.: 15/549,966

(22) PCT Filed: Feb. 16, 2016

(86) PCT No.: PCT/US2016/018128
§ 371 (c)(1),
(2) Date: Aug. 9, 2017

(87) PCT Pub. No.: WO2016/133934
PCT Pub. Date: Aug. 25, 2016

(65) Prior Publication Data

US 2018/0023807 A1 Jan. 25, 2018

Related U.S. Application Data

(60) Provisional application No. 62/117,395, filed on Feb. 17, 2015.

(51) Int. Cl.
*F23D 14/26* (2006.01)
*F23D 11/40* (2006.01)

(52) U.S. Cl.
CPC ..... *F23D 11/406* (2013.01); *F23D 14/26* (2013.01)

(58) Field of Classification Search
CPC ..... F23D 11/406; F23D 14/26
See application file for complete search history.

(56) References Cited

U.S. PATENT DOCUMENTS 3,228,614 A 1/1966 Bauer
3,488,137 A 1/1970 Naganuma
(Continued)

FOREIGN PATENT DOCUMENTS

CN 105637293 6/2016
JP 60-073242 4/1985
(Continued)

OTHER PUBLICATIONS

International Search Report for International Patent Application No. PCT/US2016/018128, dated Apr. 19, 2016 (2 pages).
(Continued)

*Primary Examiner* — Gregory A Wilson
(74) *Attorney, Agent, or Firm* — Dorsey & Whitney LLP

(57) ABSTRACT

Embodiments disclosed herein are directed to methods of upgrading a conventional combustion system into an upgraded combustion system that includes a perforated flame holder. For example, the perforated flame holder may improve operational efficiency of the combustion system and/or reduce pollutants such as $NO_x$ output by the upgraded combustion system.

16 Claims, 7 Drawing Sheets

(56) References Cited

U.S. PATENT DOCUMENTS 3,810,732 A * 5/1974 Koch ..... F23C 99/006 431/7
3,841,824 A * 10/1974 Bethel ..... F23C 99/001 431/8
3,847,536 A * 11/1974 Lepage ..... F23D 14/14 431/329
4,021,188 A * 5/1977 Yamagishi ..... F23C 6/04 431/158
4,081,958 A 4/1978 Schelp
4,397,356 A * 8/1983 Retallick ..... E21B 36/02 122/31.1
4,408,461 A 10/1983 Bruhwiler et al.
4,473,349 A * 9/1984 Kumatsu ..... F23C 5/00 431/116
4,483,673 A 11/1984 Murai et al.
4,519,770 A 5/1985 Kesselring et al.
4,588,373 A * 5/1986 Tonon ..... F24C 3/14 126/39 J
4,624,631 A * 11/1986 Kobayashi ..... F23D 11/40 431/9
4,673,349 A 6/1987 Abe et al.
4,676,737 A 6/1987 Suzuki et al.
4,726,767 A 2/1988 Nakajima
4,752,213 A * 6/1988 Grochowski ..... F23D 14/02 431/328
4,773,847 A 9/1988 Shukla et al.
5,235,667 A 8/1993 Canfield et al.
5,248,255 A 9/1993 Morioka et al.
5,326,257 A 7/1994 Taylor et al.
5,375,999 A 12/1994 Aizawa et al.
5,380,192 A * 1/1995 Hamos ..... F23D 14/02 431/328
5,409,375 A 4/1995 Butcher
5,429,059 A 7/1995 Wagoner et al.
5,431,557 A * 7/1995 Hamos ..... F23D 14/02 431/328
5,439,372 A 8/1995 Duret et al.
5,441,402 A * 8/1995 Reuther ..... F23D 14/02 431/328
5,511,516 A 4/1996 Moore, Jr. et al.
5,511,974 A 4/1996 Gordon et al.
5,567,147 A * 10/1996 Fenn ..... F23D 14/14 431/328
5,641,282 A 6/1997 Lee et al.
5,649,529 A 7/1997 Lu et al.
5,669,766 A * 9/1997 Hufton ..... F23D 1/00 110/261
5,746,194 A * 5/1998 Legutko ..... F23D 14/18 126/91 A
5,957,682 A 9/1999 Kamal et al.
6,095,798 A * 8/2000 Mitani ..... F23C 9/08 431/215
6,159,001 A 12/2000 Kushch et al.
6,162,049 A * 12/2000 Pellizzari ..... F23D 14/62 239/417.3
6,206,686 B1 3/2001 Nieszczur et al.
6,270,336 B1 8/2001 Terashima et al.
6,752,620 B2 * 6/2004 Heier ..... F23C 5/32 431/173
7,243,496 B2 * 7/2007 Pavlik ..... F23C 99/001 431/2
8,327,538 B2 12/2012 Wang et al.
9,377,190 B2 6/2016 Karkow et al.
9,388,981 B2 7/2016 Karkow et al.
9,447,965 B2 9/2016 Karkow et al.
9,562,682 B2 2/2017 Karkow et al.
2004/0081933 A1 4/2004 St. Charles et al.
2006/0141413 A1 6/2006 Masten et al.
2007/0020567 A1 * 1/2007 Branston ..... F23C 99/001 431/8
2008/0268387 A1 10/2008 Saito et al.
2009/0053664 A1 2/2009 Staller et al.
2011/0076629 A1 * 3/2011 Mosiewicz ..... F23D 14/105 431/174
2011/0183275 A1 * 7/2011 Kuske ..... C01B 3/363 431/3
2012/0017847 A1 1/2012 Ruiz et al.
2012/0116589 A1 5/2012 Schneider et al.
2012/0164590 A1 6/2012 Mach
2012/0231398 A1 9/2012 Carpentier et al.
2014/0227646 A1 8/2014 Krichtafovitch et al.
2014/0295360 A1 10/2014 Wiklof et al.
2015/0118629 A1 4/2015 Colannino et al.
2015/0276217 A1 10/2015 Karkow et al.
2015/0316261 A1 11/2015 Karkow et al.
2015/0330625 A1 11/2015 Karkow et al.
2015/0362177 A1 12/2015 Krichtafovitch et al.
2015/0362178 A1 12/2015 Karkow et al.
2015/0369477 A1 12/2015 Karkow et al.
2016/0003471 A1 1/2016 Karkow et al.
2016/0018103 A1 1/2016 Karkow et al.
2016/0025333 A1 1/2016 Karkow et al.
2016/0025374 A1 1/2016 Karkow et al.
2016/0025380 A1 1/2016 Karkow et al.
2016/0046524 A1 2/2016 Colannino et al.
2016/0091200 A1 3/2016 Colannino et al.
2016/0230984 A1 8/2016 Colannino et al.
2016/0238240 A1 8/2016 Colannino et al.
2016/0238242 A1 * 8/2016 Karkow ..... F23M 9/06
2016/0238277 A1 8/2016 Colannino et al.
2016/0238318 A1 8/2016 Colannino et al.
2016/0245509 A1 8/2016 Karkow et al.
2016/0276212 A1 10/2016 Rutkowski et al.
2016/0290639 A1 10/2016 Karkow et al.
2016/0298838 A1 * 10/2016 Karkow ..... F23N 1/022
2016/0298840 A1 10/2016 Karkow et al.
2016/0304343 A1 10/2016 Rutkowski et al.
2016/0305660 A1 10/2016 Colannino et al.
2016/0348899 A1 12/2016 Karkow et al.
2016/0348900 A1 12/2016 Colannino et al.
2016/0348901 A1 12/2016 Karkow et al.
2017/0010019 A1 1/2017 Karkow et al.
2017/0038063 A1 2/2017 Colannino et al.
2017/0038064 A1 * 2/2017 Colannino ..... F23D 11/406
2017/0051913 A1 2/2017 Colannino et al.
2017/0146232 A1 5/2017 Karkow et al.
2017/0184303 A1 6/2017 Colannino et al.
2017/0191655 A1 7/2017 Colannino et al.
2017/0268772 A1 9/2017 Lang, Sr. et al.
2017/0307212 A1 10/2017 Kendrick
2017/0350591 A1 12/2017 Karkow et al.
2018/0003378 A1 1/2018 Karkow et al.
2018/0017249 A1 1/2018 Karkow et al.
2018/0023810 A1 1/2018 Karkow et al.
2018/0038588 A1 2/2018 Karkow et al.
2018/0038589 A1 2/2018 Karkow et al.
2018/0087774 A1 3/2018 Karkow et al.
2019/0011123 A1 1/2019 Dansie et al.
2019/0107331 A1 4/2019 Kendrick et al.
2019/0137096 A1 5/2019 Kendrick et al.
2019/0203935 A1 7/2019 Wiklof

FOREIGN PATENT DOCUMENTS

WO 2014127305 A1 8/2014
WO 2014127307 A1 8/2014
WO WO 2015/123149 8/2015
WO WO 2015/123683 8/2015
WO WO 2016/105489 6/2016
WO 2016133934 A1 8/2016
WO 2016133936 A1 8/2016
WO WO 2016/133936 8/2016
WO WO 2016/134061 8/2016
WO WO 2016/134068 8/2016
WO WO 2016/141362 9/2016
WO WO 2017/048638 3/2017

(56) References Cited

FOREIGN PATENT DOCUMENTS

| | | |
|---|---|---|
| WO | WO 2017/124008 | 7/2017 |
| WO | WO 2017/1240008 | 7/2017 |

OTHER PUBLICATIONS

International Search Report for International Patent Application No. PCT/US2016/018133, dated Apr. 21, 2016 (2 pages).
Written Opinion of the International Searching Authority for International Patent Application No. PCT/US2016/018128, dated Apr. 19, 2016 (7 pages).
Written Opinion of the International Searching Authority for International Patent Application No. PCT/US2016/018133, dated Apr. 21, 2016 (4 pages).
Fric, Thomas F., "Effects of Fuel-Air Unmixedness on NOx Emissions," Sep.-Oct. 1993. Journal of Propulsion and Power, vol. 9, No. 5, pp. 708-713.
Advisory Action for U.S. Appl. No. 15/549,957 dated May 13, 2020.
Issue Notification for U.S. Appl. No. 15/549,957 dated Sep. 23, 2020.

* cited by examiner

METHODS OF UPGRADING A CONVENTIONAL COMBUSTION SYSTEM TO INCLUDE A PERFORATED FLAME HOLDER

CROSS-REFERENCE TO RELATED APPLICATION

This application claims priority to U.S. Provisional Application No. 62/117,395 filed on Feb. 17, 2015, and titled METHODS OF UPGRADING A CONVENTIONAL COMBUSTION SYSTEM TO INCLUDE A PERFORATED FLAME HOLDER, the disclosure of which is incorporated herein, in its entirety, by this reference.

BACKGROUND

There are many different types of burners and combustion systems. Generally, a burner or combustion system includes a fuel nozzle that injects fuel into a combustion chamber. The fuel mixes with an oxidant (e.g., air) and, after mixing, the fuel and oxidant mixture is ignited and combusted in the combustion chamber to generate heat. Furthermore, heat generated by the combustion system may be transferred and may raise a temperature of one or more objects and/or materials. For example, heat may be transferred from the combustion system to one or more pipes in a boiler system.

One or more pollutants may be produced during combustion of the fuel. Typically, such pollutants are exhausted into an outside environment and/or atmosphere and may have a negative impact on that environment. In addition, typical combustion systems operate below a theoretical maximum efficiency for converting chemical energy of the fuel into heat, which may be transferred to one or more objects or materials that are heated by the combustion system.

Therefore, developers and users of burners and combustion systems continue to seek improvements to operating efficiency thereof and/or production of pollutants thereby.

SUMMARY

Embodiments disclosed herein are directed to methods of upgrading a conventional combustion system into an upgraded combustion system that includes a perforated flame holder. For example, the perforated flame holder may improve operational efficiency of the combustion system and/or reduce pollutants (such as oxides of nitrogen "$NO_x$") output by the upgraded combustion system.

In an embodiment, a method of upgrading a conventional combustion system having a combustion chamber is disclosed. A first fuel nozzle assembly is removed from the conventional combustion system. A flame holder assembly is installed into the combustion chamber. The flame holder assembly includes a perforated flame holder mounted to a support structure. The perforated flame holder includes a body having a plurality of through-holes extending between an upstream side thereof and a downstream side thereof. A second fuel nozzle assembly is installed into the combustion system to replace the first fuel nozzle assembly. For example, the second fuel nozzle assembly may be specifically configured to deliver fuel and oxidant for combustion in and/or near the perforated flame holder. The second fuel nozzle assembly may be formed by modifying the first fuel nozzle assembly, such as by removing one or more vortex generating structures (e.g., swirl vanes) therefrom.

In another embodiment, another method of upgrading a conventional combustion system having a combustion chamber is disclosed. A fuel nozzle assembly is removed from the conventional combustion system. The fuel nozzle assembly is modified. A flame holder assembly is installed into the combustion chamber. The flame holder assembly includes a perforated flame holder mounted to a support structure. The perforated flame holder includes a body having a plurality of through-holes extending between an upstream side thereof and a downstream side thereof. The modified fuel nozzle assembly is installed into the combustion system. For example, the fuel nozzle assembly may be modified by removing one or more vortex generating structures (e.g., swirl vanes) that would otherwise cause a flame to be held upstream from the perforated flame holder.

In yet another embodiment, another method of upgrading a conventional combustion system having a combustion chamber is disclosed. A first fuel nozzle assembly is removed from the conventional combustion system. The first fuel nozzle assembly includes one or more vortex generating structures configured to promote combustion in and/or near an output of the first fuel nozzle assembly. A flame holder assembly is installed into the combustion chamber. The flame holder assembly includes a perforated flame holder mounted to a support structure. The perforated flame holder includes a body having a plurality of through-holes extending between an upstream side thereof and a downstream side thereof. A second fuel nozzle assembly is installed into the combustion system. The second fuel nozzle assembly is configured to deliver fuel and oxidant to the perforated flame holder for combustion in and/or near the perforated flame holder. The perforated flame holder is positioned a distance from the second fuel nozzle assembly.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Embodiments disclosed herein are directed to methods of upgrading a conventional combustion system to include a perforated flame holder that may improve an operational efficiency of the combustion system and/or reduce pollutants (such as oxides of nitrogen "$NO_x$.") output by the upgraded combustion system. In some embodiments, an upgraded combustion system includes a perforated flame holder in and/or near a location where a combustion reaction occurs along with a fuel nozzle assembly that does not include one or more vortex generating structures (e.g., swirl vanes or conventional burner tile). The perforated flame holder may be specifically configured to operate with the fuel nozzle assembly or a modified fuel nozzle assembly in which one or more vortex generating structures has been removed or omitted therefrom, a conventional burner tile has been removed or omitted therefrom, or certain components of the conventional combustion system are rendered non-essential for operation or non-operative. In some embodiments, a position of the perforated flame holder may be selected such that the perforated flame holder may be positioned at or near a centroid or a terminal end of a flame in the conventional combustion system prior to the conventional combustion system being upgraded with the perforated flame holder in order to be efficient for radiation heat transfer components of the combustion system or for locating the perforated flame holder where sufficient mixing of fuel and oxidant occurs.

Figure 1:
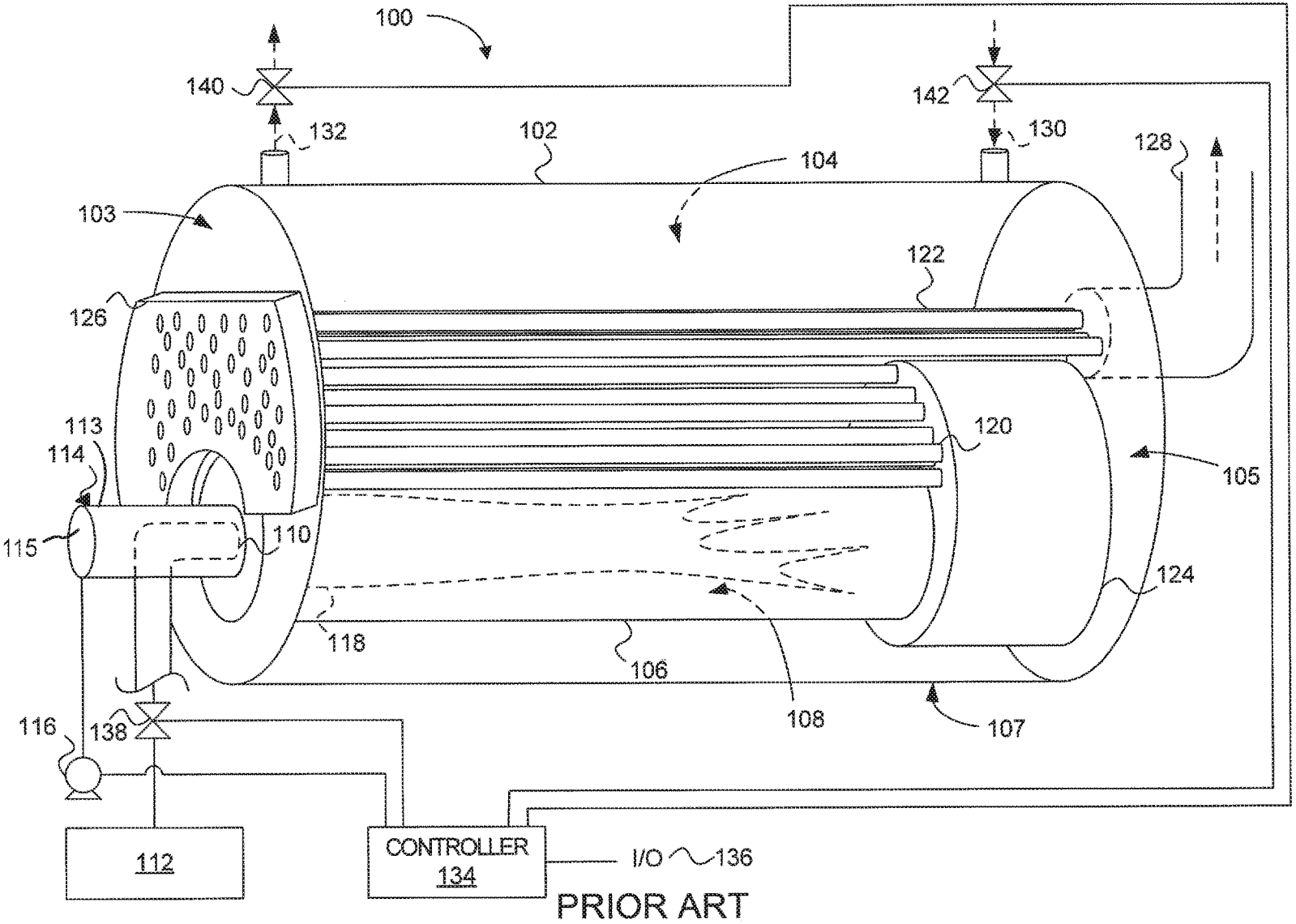
FIG. 1 PRIOR ART
FIG. 1 is an isometric view of a conventional combustion system.

FIG. 1 is an isometric view of a conventional combustion system 100 configured as a fire-tube boiler that may be upgraded to include a perforated flame holder according to embodiments disclosed herein, as discussed in more detail below with respect to FIGS. 3-6. While the conventional combustion system 100 is illustrated in relation to a fire-tube boiler, the principles of upgrading combustion systems disclosed herein are applicable to any type of burner including combustion systems other than fire-tube boilers.

The combustion system 100 includes a shell 102 configured to hold water 104. The shell 102 includes a front wall 103, a back wall 105 spaced from the front wall 103, and a peripheral wall 107 extending between the front wall 103 and the back wall 105. A combustion pipe 106 may be disposed at least partially inside the shell 102 and defines a combustion volume or chamber 108. The combustion pipe 106 also keeps the water 104 out of the combustion chamber 108. The combustion pipe 106 may also be referred to as a Morrison tube or furnace. A fuel nozzle assembly 114 includes a fuel nozzle 110 disposed to receive fuel from a fuel source 112 and output a fuel jet into the combustion chamber 108, and an outer tube 113 that encloses the fuel nozzle 110 and is coupled to an oxidant source 115 disposed to output oxidant (e.g., air) into the combustion chamber 108. The oxidant source 115 may include a natural draft air source or, alternatively, may receive air from a blower 116. Various fuels are used in commercially available fire-tube boilers. For example, the combustion system 100 can use natural gas, propane, #2 fuel oil, #6 fuel oil, or combinations thereof.

The fuel jet and oxidant together support a conventional flame 118 in the combustion chamber 108. The flame 118 produces hot flue gas that is circulated through fire tubes 120, 122 that, together with the wall of the combustion pipe 106, transfer heat produced by the flame 118 to the water 104. In the combustion system 100, the fire tubes 120, 122 and the combustion pipe 106, form a three pass system with hot flue gas being produced in the combustion pipe 106 flowing from left to right, a second pass of fire tube 120 supporting flue gas flow from right to left, and a third pass of fire tube 122 supporting flue gas flow from left to right. Each "turn" of flue gas direction is made in a plenum 124, 126. Various numbers of passes, such as between one (combustion pipe 106 only) and four, are typically used according to the design preferences for a given installation or standard product. In a "wet back" boiler, the plenum 124 has a wall separate from the back wall 105 with space for the boiler water 104 to circulate therebetween. Other types of boiler configurations include a so called "dry back" boiler.

Cooled flue gas is vented to the atmosphere through an exhaust flue 128. Optionally, the vented flue gas may pass through an economizer that pre-heats the oxidant, the fuel, and/or feeds water 130 to the combustion system 100. The water 104 may consist essentially of (hot) liquid water (e.g., except for boiling that may occur immediately adjacent to the heat transfer surfaces of the fire tubes 120, 122 and the combustion pipe 106), or may include liquid water and saturated steam 132. The output hot water or steam 132 is transported for use as a heat source for a variety of industrial, commercial, or residential purposes.

An automatic controller 134 may be used to control output of hot water or steam 132 according to demand received via a data interface 136. The controller 134 can control fuel flow using a fuel valve 138 and can control an air damper or blower 116 to match the heat output of the flame 118 thereby controlling heat output according to hot water or steam 132 demand. The controller 134 can further control a steam or hot water valve 140 and/or a feed water valve 142 to control the flow rate of water 104 through the combustion system 100.

Figure 2:
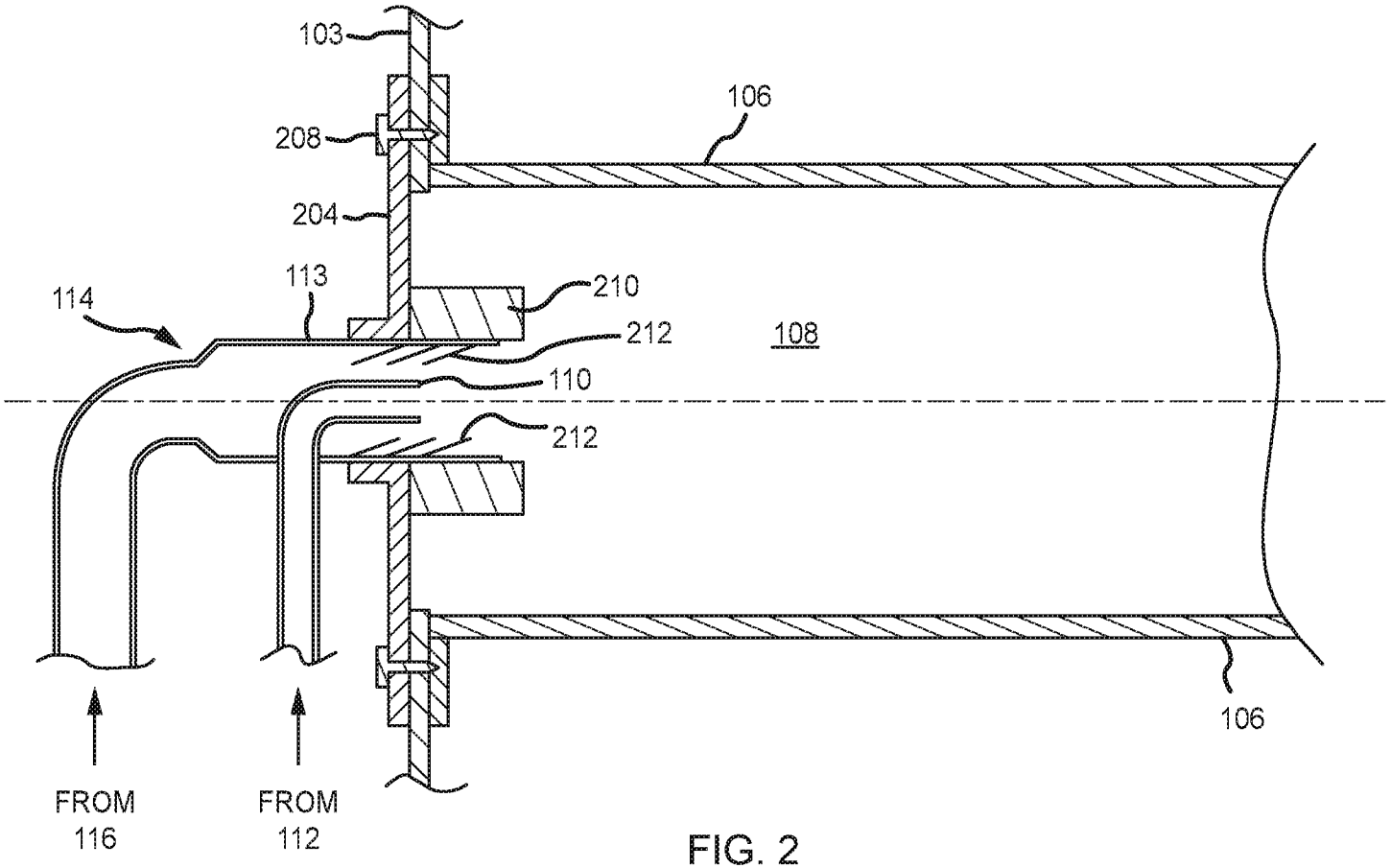
FIG. 2 PRIOR ART
FIG. 2 is a partial cross-sectional view of the combustion system of FIG. 1.

FIG. 2 is a partial cross-sectional view of the conventional combustion system 100 of FIG. 1. The fuel nozzle assembly 114 is inserted through a base 204 that is attached to the front wall 103 of the shell 102 of the combustion system 100 via one or more fasteners 208. The base 204 may extend to cover an end of the combustion chamber 108, and is attached to the front wall 103 by the one or more fasteners 208.

The fuel nozzle assembly 114 may include swirl vanes 212 or other vortex generating structures (e.g., a bluff body), which may be aligned to cause vortices to form near the fuel nozzle 110. The vortices may recycle heat released by the combustion reaction back to incoming fuel (e.g., from fuel source 112) and oxidant (e.g., from a natural draft or blower 116), thereby causing the flame 118 to be maintained or anchored at or near the fuel nozzle 110, which is undesirable if the combustion system 100 is to be upgraded with a perforated flame holder located downstream in and/or near a location where the combustion is desired to occur.

The fuel nozzle assembly 114 may also include a tile body 210 at least partially surrounding a periphery of the outer tube 113 of the fuel nozzle assembly 114. The tile body 210 may be attached to the base 204, the outer tube 113, or may simply rest on the base 204 and/or the outer tube 113. The tile body 210 may be used in addition to or in place of the swirl vanes 212 to generate vortices that recirculate heat to promote combustion near the fuel nozzle assembly 114, such as near the fuel nozzle 110.

The upgraded combustion systems disclosed herein may include a fuel nozzle assembly, which may be different from the conventional fuel nozzle assembly 114 shown in FIGS. 1 and 2. For example, the fuel nozzle assembly may be specifically configured to operate with the perforated flame holders disclosed herein or may be formed by modifying the conventional fuel nozzle assembly 114 to operate with the perforated flame holders disclosed herein. In particular, the upgraded fuel nozzle assembly is configured to, at least selectively, cause heat not to be recycled near the fuel nozzle assembly 114, and thereby allow fuel and oxidant to reach the perforated flame holder prior to ignition of the combustion reaction.

Figure 3:
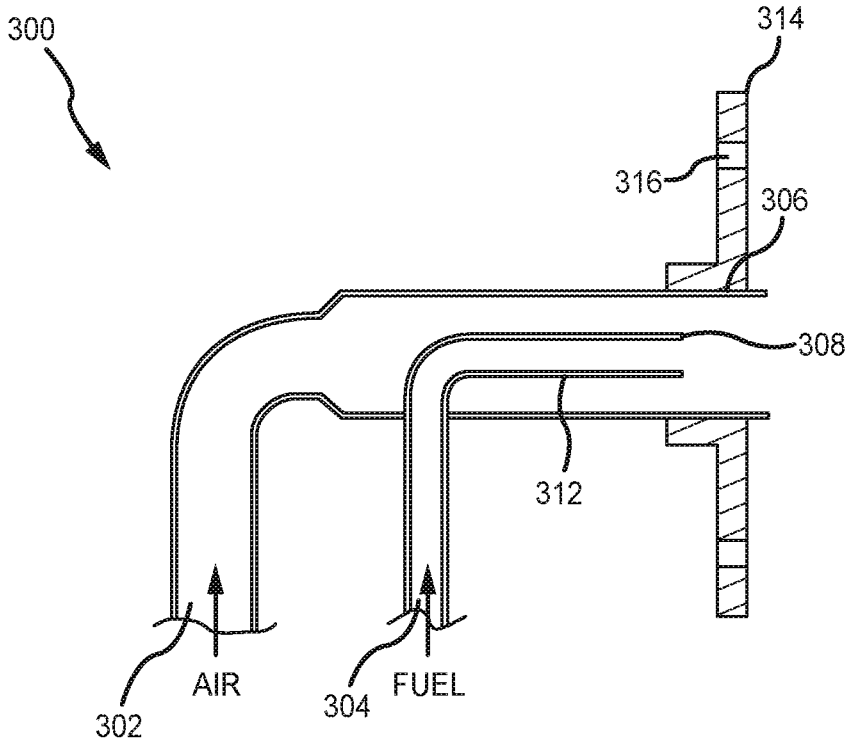
FIG. 3 is a cross-sectional view of a modified fuel nozzle assembly according to an embodiment.

FIG. 3 is a cross-sectional view of a modified fuel nozzle assembly 300 according to an embodiment. The fuel nozzle assembly 300 may include a base 314 that has through-holes 316 for attaching the fuel nozzle assembly 300 to the front wall 103 of the shell 102 of the combustion system 100 (FIGS. 1-2) and/or another suitable mounting structure. The base 314 may be configured to receive the fuel nozzle assembly 300. For example, the base 314 may include an opening that is generally centrally located and through which at least a portion of the fuel nozzle assembly 300 partially or completely extends (e.g., outer tube 306).

The fuel nozzle assembly 300 may include an inner tube 312 fluidly coupled to a fuel nozzle 308 through which fuel 304 is output into a combustion chamber (e.g., combustion chamber 108 of FIGS. 1-2). The fuel nozzle assembly 300 may also include an outer tube 306 for receiving an oxidant 302 (e.g., combustion gas or air) and outputting the oxidant into the combustion chamber.

In some embodiments, the fuel nozzle assembly 300 may be modified by removing the swirl vanes 212 from the conventional fuel nozzle assembly 114, removing the tile body 210, removing other vortex generating structures configured to cause vortices to form near the fuel nozzle 110, or combinations thereof. For example, the swirl vanes 212 may be unbolted from the fuel nozzle assembly 114 and/or machined therefrom. In some embodiments, the fuel nozzle assembly 300 is a specifically configured fuel nozzle assembly configured to operate with a perforated flame holder 404 (FIG. 4A) so that a mixture of fuel and oxidant does not ignite at and/or near the fuel nozzle 308 and the mixture reaches the perforated flame holder 404 (FIG. 4A) in and/or near which the combustion reaction is desired to occur.

Figure 4A:
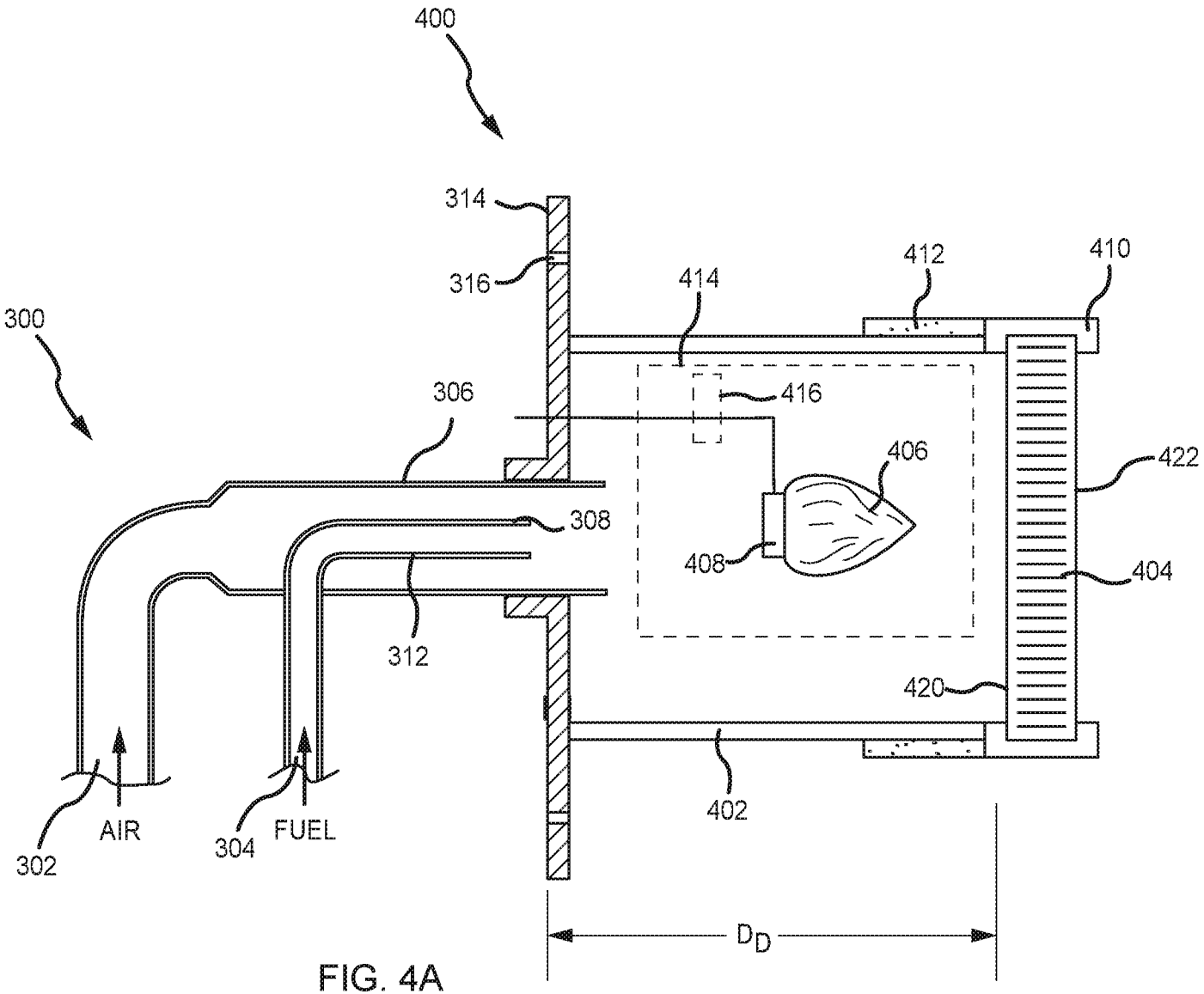
FIG. 4A is a cross-sectional view of a combustion system including a flame holder assembly according to an embodiment.

As discussed above, the upgraded combustion system includes a flame holder assembly 400 including the perforated flame holder 404. FIG. 4A is a cross-sectional view of the flame holder assembly 400 according to an embodiment. The flame holder assembly 400 includes a support structure 402 that is attached to a housing 410 to which the perforated flame holder 404 is mounted. The support structure 402 provides structural support for the perforated flame holder 404. In an embodiment, the support structure 402 may include legs coupled to the base 314. The legs have a length selected to position the perforated flame holder 404 at a selected position, such as at or near a centroid or a terminal tip of the flame 118 (FIG. 1) of the conventional combustion system 100 (FIG. 1). For example, the centroid of the flame 118 or flame radiation may be determined during standard operating conditions for the conventional combustion system 100. In another embodiment, the terminal tip of the flame 118 may be determined during standard operating conditions for the conventional combustion system 100.

Figure 4B:
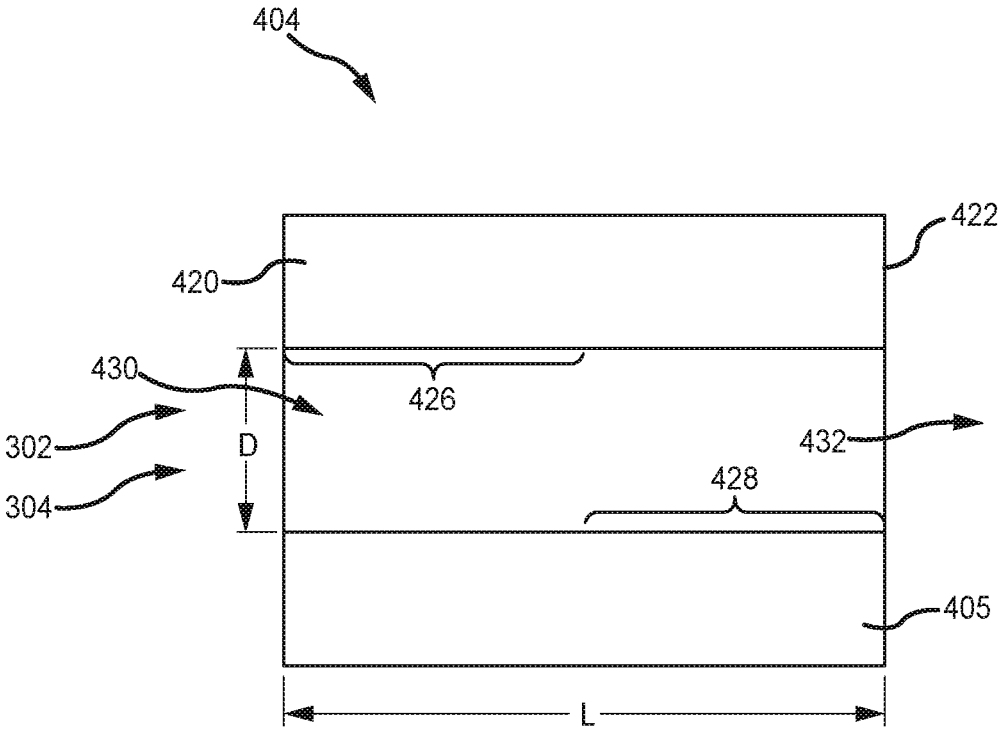
FIG. 4B is a cross-sectional view of a portion of the perforated flame holder of FIG. 4A according to an embodiment.

FIG. 4B is a cross-sectional view of the perforated flame holder 404 shown in FIG. 4A according to an embodiment. For simplicity, only one perforation or through-hole 430 is shown, although the perforated flame holder 404 may include a body 405 defining a plurality of through-holes 430 (i.e., void volumes) through which a mixture including fuel and an oxidant (e.g., air or oxygen) flows, and a combustion reaction of the fuel and oxidant may occur in and/or near. The perforated flame holder 404 includes upstream and downstream sides 420 and 422, with the through-holes 430 extending completely through the body 405 at and from the upstream side 420 to the downstream side 422 of the perforated flame holder 404. The through-holes 430 may have any suitable shape including, but not limited to, circular, square, rectangular, or irregular shapes. The cross-sectional geometry of the through-holes 430 may be uniform as shown or non-uniform. Examples of suitable configurations for the perforated flame holder 404 are disclosed in PCT International Application No. PCT/US2014/016628 filed on 14 Feb. 2014, the disclosure of which is incorporated by reference herein in its entirety.

The perforated flame holder 404 may be formed of a thermal insulator that is capable of surviving high temperature combustion. For example, the perforated flame holder 404 may include one or more of a refractory material (e.g., at least one of cordierite or mullite) or a high-temperature alloy (e.g., a nickel-based superalloy such as one or the many types of Inconel® alloys).

Flue gas 432 may be produced by the combustion reaction of the fuel 304 (FIG. 3) and the oxidant 302 (FIG. 3). The fuel 304 and oxidant 302, which may flow substantially continuously from the fuel nozzle assembly 300 to the upstream side 420 of the perforated flame holder 404, may be divided into portions as the fuel 304 and oxidant 302 enter one or a plurality of through-holes 430. Each through-hole 430 may be regarded as receiving or being capable of receiving one portion of the fuel 304 and oxidant 302. The plurality of through-holes 430 may hold respective portions of the combustion reaction. The fuel and oxidant portion, a diluent portion such as molecular nitrogen, a combustion reaction portion supported by the fuel and oxidant, and a flue gas portion produced by the combustion reaction portion in the elongated through-holes 430, may be referred to as a combustion fluid.

The incoming fuel 304 and oxidant 302 may be cold or cool. In other words, the incoming fuel 304 and oxidant 302 may not be heated until they get close to the perforated flame holder 404. The cold fuel 304 and oxidant 302 may become heated from interaction with the perforated flame holder 404 and then the combustion reaction may occur in and/or near the through-holes 430 of the perforated flame holder 404.

The body 405 of the perforated flame holder 404 may be configured to output heat to the fuel 304 and oxidant 302 at least in a first region 426 of the through-holes 430 near the upstream side 420 such that the incoming fuel 304 and oxidant 302 are heated in the first region 426 of the through-holes 430 near the upstream side 420. This results in heating and an increase in temperature of the fuel 304 and oxidant 302 sufficient to cause ignition of the combustion reaction and to maintain combustion reaction of the fuel 304 and oxidant 302. The combustion reaction may also occur in a second region 428 of the through-holes 430 near the downstream side 422. There may be a net transfer of heat from the second region 428 near the downstream side 422 to the first region 426 near the upstream side 420. The heat released by the exothermic combustion reaction may be recycled upstream to heat the incoming fuel 304 and oxidant 302. This heat transfer may help reduce the peak combustion temperature and, thus, may promote reducing production of $NO_x$ during combustion.

Referring again to FIG. 4A, in some embodiments, the flame holder assembly 400 may further include a combustion start-up device 414 for preheating the perforated flame holder 404, or for starting or initiating the combustion reaction. In some embodiments, the combustion start-up device 414 may use a flame to preheat the perforated flame holder 404. For example, the combustion start-up device 414 may include a start-up flame holder 408 configured to temporarily hold a start-up flame 406 disposed to output heat to the perforated flame holder 404. The start-up flame holder 408 may be configured to cause vortices to circulate heat to maintain the start-up flame 406 or act as a substantially continuous ignition source to maintain the start-up flame 406. The combustion start-up device 414 may be configured to preheat the perforated flame holder 404 prior to introducing the fuel 304 and oxidant 302 flow to the perforated flame holder 404. If the perforated flame holder 404 is not hot enough to cause automatic ignition of the fuel and oxidant mixture, the perforated flame holder 404 may not be able to generate or sustain a combustion reaction.

The start-up flame holder 408 may include a retraction mechanism, such that the start-up flame holder 408 may be mechanically retracted to a position 416 and, in operation, the start-up flame holder 408 does not hold the start-up flame 406 after the perforated flame holder 404 reaches an operating temperature. The start-up flame holder 408 may be manually operated by an operator. Alternatively, the start-up flame holder 408 may include an actuator configured to actuate a position of the start-up flame holder 408 in response to a control signal from a controller. More detailed description of the controller is provided below in relation to FIG. 5.

In some embodiments, the combustion start-up device 414 may include an electrical discharge igniter configured to output a pulsed ignition to the fuel 304 and oxidant 302. In some embodiments, the combustion start-up device 414 may include a pilot flame component disposed to ignite a fuel and oxidant mixture entering and/or about to enter the perforated flame holder 404. The electrical discharge igniter and/or pilot flame apparatus may be configured to maintain combustion of the fuel and oxidant mixture in and/or upstream from the perforated flame holder 404, before the perforated flame holder 404 is heated sufficiently to maintain combustion.

In some embodiments, the combustion start-up device 414 may include an electrical resistance heater configured to output heat to and heat the perforated flame holder 404. In such an embodiment, a voltage source may be operatively coupled to the electrical resistance heater by a switch configured to establish or break contact between the voltage source and the electrical resistance heater. The electrical resistance heater may exhibit a number of different configurations. For example, the electrical resistance heater may be formed from KANTHAL® wire (available from Sandvik Materials Technology division of Sandvik AB of Hallstahammar, Sweden) threaded through at least a portion of through-holes 430 in the perforated flame holder 404. In other embodiments, the combustion start-up device 414 may be configured as or include an inductive heater, a high energy (e.g. microwave or laser) beam heater, a frictional heater, or other types of heating technologies.

In the illustrated embodiment, the flame holder assembly 400 includes a thermal insulation 412 that may be thermally coupled to the support structure 402. However, in other embodiments, the thermal insulation 412 may be omitted. The thermal insulation 412 may help retain the heat near the perforated flame holder 404 and within the support structure 402, such that the fuel 304 and oxidant 302 may be preheated before entering the perforated flame holder 404 from the upstream side 420. In some embodiments, the thermal insulation 412 may be supported by the support structure 402 adjacent to the combustion pipe 106 (FIG. 2) of the combustion chamber 108 along at least a portion of a distance between the fuel nozzle assembly 300 and the perforated flame holder 404. In some embodiments, the thermal insulation 412 may be attached to the combustion pipe 106 of the combustion chamber 108. In an embodiment, the thermal insulation 412 may be formed from a polymer, such as a one inch thick FIBERFRAX© DURABLANKET© high temperature insulating blanket, available from UNIFRAX I LLC of Niagara Falls, N.Y.

By using the perforated flame holder 404, the combustion reaction may occur at leaner fuel and oxidant mixtures than would ordinarily stably burn. The perforated flame holder 404 is positioned at a dilution distance $D_D$ from the fuel nozzle assembly 300. The combustion reaction, thus, occurs in and/or near the perforated flame holder 404. Initially, a fuel and oxidant mixture is ignited by the combustion start-up device 414. After the start-up combustion reaction is ignited, heat from the combustion reaction increases a temperature of the perforated flame holder 404, such that the heated perforated flame holder 404 may maintain a stable combustion reaction that produces reduced $NO_x$.

The perforated flame holder 404 may be configured to combust the fuel and oxidant mixture at lower combustion temperatures than the conventional combustion system 100 (FIGS. 1 and 2), while also minimizing residence time at the combustion temperature, such that very low $NO_x$ exits from the downstream side 422. The combustion reaction may occur at a lower combustion temperature because the perforated flame holder 404 (e.g., the body 405) may radiate and/or reduce the combustion heat generated from the combustion reaction and, thus, may reduce a combustion peak temperature. As a result, relatively less $NO_x$ is generated from the combustion reaction. In some embodiments, a combustion reaction supported by the perforated flame holder 404 may have a relatively lean fuel and oxidant mixture that also helps reduce combustion peak temperature.

Referring again to FIG. 4B, in some embodiments, the plurality of through-holes 430 may be each characterized by a lateral dimension D equal to or greater than a flame quenching distance. The flame quenching distance is defined as a diameter of an orifice such that a stoichiometrically premixed flame cannot propagate upstream through the orifice into a premix reservoir under published standard conditions. The quenching distance evaluated under stoichiometric conditions may be a property of the fuel. For example, most hydrocarbons have quenching distances of about 0.1 inch. When the lateral dimension D is greater than the flame quenching distance, the perforated flame holder 404 may provide more stable combustion reaction. Alternatively, the elevated temperature at which the perforated flame holder 404 is generally operated may have an effect on overcoming standard "quenching distances." A length L of each of the through-holes 430 is equal to a distance between the upstream side 420 and downstream side 422 (i.e., thickness) of the perforated flame holder 404. In some embodiments, the thickness may be proportional to the lateral dimension D. In some embodiments, a relatively larger lateral dimension D for the through-holes 430 may be used in combination with a relatively larger length L for the through-holes 430 to achieve the lowest $NO_x$ production. In some embodiments, a relatively smaller lateral dimension D for the through-holes 430 may operate effectively with a relatively smaller though-hole length L.

Void fraction may be expressed as (total perforated flame holder 404 volume—body 405 volume)/total perforated flame holder 404 volume. Increasing the void fraction may decrease flow resistance of combustion fluids through the perforated flame holder 404. However, increasing the void fraction too much may make the perforated flame holder 404 more fragile and/or may reduce the heat capacity of the flame holder body 405 which may reduce the effectiveness in maintaining combustion in the perforated flame holder 404. The void fraction may vary with the shape or size of the perforation or void pattern. For example, for honeycomb perforated flame holders, the void fraction may be at least 50%, such as about 50% to about 70% to be effective in maintaining the combustion reaction. A lower void fraction of about 10% or less may also be effective in maintaining the combustion reaction. Such a lower void fraction (e.g., 10%) may be used when the perforated flame holder 404 is formed from a relatively fragile material.

Referring to FIG. 4A again, the support structure 402 supports the perforated flame holder 404 at the dilution distance $D_D$ from the fuel nozzle 308 (FIG. 3). In some embodiments, the dilution distance $D_D$ may be at least 20 times a nozzle diameter of the fuel nozzle 308 (FIG. 3). In some embodiments, the dilution distance $D_D$ may be at least 100 times a nozzle diameter of the fuel nozzle 308 (FIG. 3). In another embodiment, the dilution distance $D_D$ may be 245 nozzle diameters or more. In another embodiment, the dilution distance $D_D$ may be about 265 nozzle diameters. The perforated flame holder 404 may be positioned at a particular dilution distance $D_D$ from the fuel nozzle assembly 300, such that a minimum or a reduced amount of $NO_x$ may be produced during combustion. This distance may be determined experimentally. Experiments may be performed to determine the effect of the dilution distance $D_D$ on the output of $NO_x$. The inventors have found that distances between 100 and 1100 nozzle diameters for the dilution distance $D_D$ have worked well.

In some embodiments, the perforated flame holder 404 may be located for efficient heat transfer from a combustion chamber (e.g., combustion chamber 108 FIGS. 1-2) to a radiation heat transfer assembly that contains a working fluid to be heated. Thus, a centroid of the conventional flame 118 (FIG. 1) generated from the conventional fuel nozzle assembly 114 (FIGS. 1-2) prior to being upgraded with the flame holder assembly 400 may be determined. For example, the centroid may be determined from image capture and image analysis of the conventional flame 118. The perforated flame holder 404 may be placed at the dilution distance $D_D$ from the fuel nozzle assembly 300 by the support structure 402 such that the perforated flame holder 404 is positioned generally at or near this centroid of the conventional flame 118. The centroid of the flame 118 is where the perforated flame holder 404 may be more efficient for heating heat transfer components of the combustion system. While the conventional combustion system 100 shown in FIG. 1 is configured as a fire-tube boiler that is not particularly sensitive to radiant heat transfer, other types of combustions systems are relatively more sensitive to radiation heat transfer. For example, a steam tube boiler, which is typically used for very large systems, such as electric power generation, includes a radiation heat transfer section for producing superheat in the steam. Locating the perforated flame holder 404 at or near the centroid of the conventional flame 118 may be beneficial in a steam tube boiler or other combustion systems that are relatively more sensitive to radiation heat transfer than a fire-tube boiler.

Figure 5:
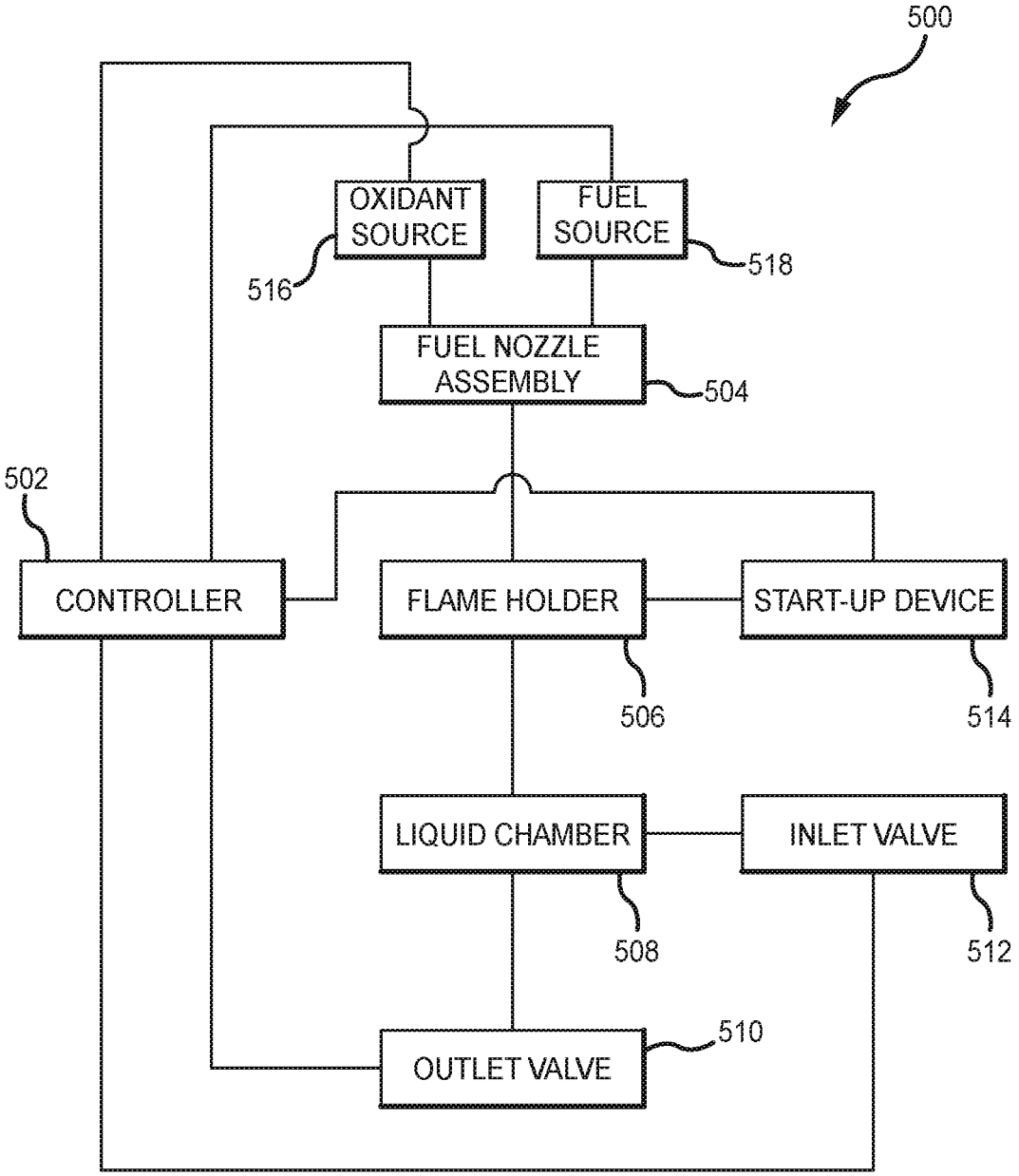
FIG. 5 is a block diagram of a boiler including an upgraded combustion system according to an embodiment.

FIG. 5 is a block diagram of an upgraded combustion system 500 according to an embodiment. The upgraded combustion system 500 includes a perforated flame holder 506 that provides heating to a liquid chamber 508 by hot flue gas generated from a combustion reaction of a fuel and oxidant from a fuel source 518 and oxidant (e.g., air) source 516 output through a fuel nozzle assembly 504. The upgraded combustion system 500 may also include a controller 502 coupled to a combustion start-up device 514 configured to ignite the combustion reaction in the perforated flame holder 506. The start-up device 514 preheats the perforated flame holder 506. The controller 502 may also be operatively coupled to the oxidant source 516 and the fuel source 518 to control flow rates of the fuel and oxidant. The controller 502 may also be operatively coupled to an inlet valve 512 and outlet valve 510 for controlling flow rates into and from the liquid chamber 508.

In operation, upon receiving a start-up command, the controller 502 may turn on the combustion start-up device 514 to heat the perforated flame holder 506 and then may turn off the combustion start-up device 514. After the preheating for a period of time, for example, the controller 502 may control the flow rates of the fuel from the fuel source 518 (e.g., open a fuel valve) and the oxidant from the oxidant source 516 (e.g., start a blower or fan) to deliver a mixture of the fuel and oxidant to the perforated flame holder 506. The fuel and the oxidant may be ignited to start the combustion reaction in and/or near the perforated flame holder 506. The combustion reaction is maintained in and/or near the flame holder 506. As the perforated flame holder 506 heats up, the controller 502 may then increase the fuel and oxidant flow to output more heat, if desired.

Figure 6:
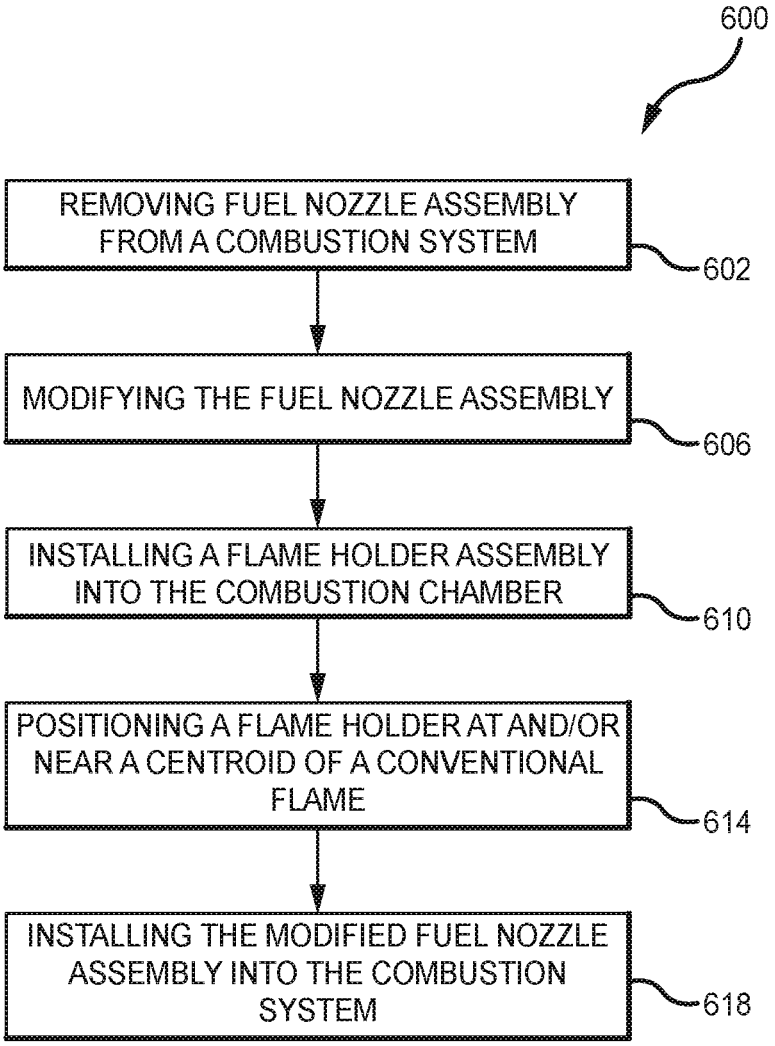
FIG. 6 is a flow chart of a method of retrofitting a conventional combustion system according to an embodiment.

FIG. 6 is a flow chart of a method 600 of upgrading a conventional combustion system according to an embodiment. The method 600 is described below with reference to certain components shown in FIG. 1, 2, 3, or 4. The method 600 includes an act 602 of removing the conventional fuel nozzle assembly 114 (FIGS. 1-2) and/or rendering certain components (e.g., certain nozzles or other components) of the conventional combustion system 100 non-essential for operation or non-operative (e.g., turning off fuel flow to one or more selected fuel nozzles). In some embodiments, the method 600 further includes an act 606 of modifying the removed fuel nozzle assembly 114 to form the modified fuel nozzle assembly 300 (FIG. 3). For example, as shown in FIG. 2, by removing the fastener 208, the conventional fuel nozzle assembly 114 including the base 204, the tile body 210, the swirl vanes 212, the outer tube 113, and the fuel nozzle 110 may be detached from the front wall 103 of the shell 102. After removing the fuel nozzle assembly 114, the fuel nozzle assembly 114 may be modified by, for example, removing the swirl vanes 212 (FIG. 2), the tile body 210 (FIG. 2) (if present), other vortex generating structures, or combinations thereof. The removal of the swirl vanes 212 and the tile body 210 is performed so that the combustion reaction occurs in and/or near the perforated flame holder 404 to be installed rather than at and/or near the fuel nozzle assembly 114.

The method 600 further includes an act 610 of installing the flame holder assembly 400 (FIG. 4) into the combustion chamber 108 (FIGS. 1-2). In the illustrated embodiment, the method 600 further includes an act 614 of positioning the perforated flame holder 404 to be at or near the centroid or the terminal end of the flame 118 (FIG. 1) of the conventional combustion system 100 in the combustion chamber 108 prior to installing the flame holder assembly 400. For example, the perforated flame holder 404 may be placed at or near the centroid or the terminal end of the flame 118 (FIG. 1). In such an embodiment, the centroid or the terminal end of the flame 118 may be first determined prior to upgrading the conventional combustion system 100, such as determining the centroid or the terminal end of the flame 118 under standard operating conditions for the conventional combustion system 100. The method 600 further includes an act 618 of installing the modified fuel nozzle assembly 300 (FIG. 3) into the combustion system.

In some embodiments, instead of modifying the fuel nozzle assembly 114 (FIG. 1) of the conventional combustion system 100, the conventional fuel nozzle assembly 114 may be replaced by a new fuel nozzle assembly that is specifically configured to operate with the perforated flame holder 404 so that the flame generated is anchored generally in and/or near the perforated flame holder 404 rather than at the fuel nozzle (e.g., fuel nozzle 110 of FIGS. 1-2 or fuel nozzle 308 of FIGS. 3-4B). For example, the new fuel nozzle assembly does not include one or more vortex generating structures, such as swirl vanes.

The order of the acts may be altered from the order shown in FIG. 6. For example, act 618 may be performed before act 610.

In some embodiments, the method 600 further includes an act of installing a preheating device (e.g., combustion start-up device 414) that is configured to heat the perforated flame holder 404 to a temperature sufficient to cause the combustion reaction in and/or near the perforated flame holder 404. In operation, the perforated flame holder 404 may be preheated.

While various aspects and embodiments have been disclosed herein, other aspects and embodiments are contemplated. The various aspects and embodiments disclosed herein are for purposes of illustration and are not intended to be limiting.

What is claimed is:

1. A method of upgrading a conventional combustion system having a combustion chamber defined by a combustion pipe disposed in a shell configured to hold water, the method comprising:

removing a first fuel nozzle assembly from the shell of the conventional combustion system, the first nozzle assembly including one or more vortex generating structures configured to promote combustion in and/or near an output of the first fuel nozzle assembly;

installing a flame holder assembly into the combustion chamber, the flame holder assembly including a refractory body and a flame holder mounted to a support structure, the flame holder assembly configured to produce a flame at least temporarily held by the flame holder; and installing a second fuel nozzle assembly at least partially into the conventional combustion system including securing a base of the second fuel nozzle assembly to the shell of the conventional combustion system, the support structure being secured to the base with the flame holder spaced from the base, wherein the second fuel nozzle assembly does not include one or more vortex generating structures configured to promote combustion in and/or near an output of the second fuel nozzle assembly.

2. The method of claim 1 wherein the second fuel nozzle assembly is configured to deliver unburned fuel and oxidant to the flame holder.

3. The method of claim 1 wherein the one or more vortex generating structures include swirl vanes.

4. The method of claim 1 further comprising modifying the first fuel nozzle assembly to form the second fuel nozzle assembly.

5. The method of claim 1, further comprising installing a preheating device that is configured to heat the flame holder to a temperature sufficient to cause a combustion reaction in and/or near the flame holder.

6. The method of claim 5 wherein the preheating device includes an electrical resistance heater.

7. The method of claim 1 wherein the support structure is configured such that the flame holder is positioned at a selected distance from the second fuel nozzle assembly inside the combustion chamber.

8. The method of claim 1 wherein the support structure includes a plurality of legs coupled to a base, the base configured to attach to a front wall of the conventional combustion system and further configured to receive the second fuel nozzle assembly, the base including an outer tube for receiving an oxidant.

9. The method of claim 8, further comprising selecting a length of the plurality of legs such that the flame holder is positioned at or near a centroid or a terminal end of a flame output by the first fuel nozzle assembly in the conventional combustion system prior to the conventional combustion system being upgraded with the flame holder assembly.

10. The method of claim 1, further comprising removing a burner tile from a position proximate to the first fuel nozzle assembly.

11. The method of claim 1, further comprising:

determining a centroid or a terminal end of a flame output by the first fuel nozzle assembly in the combustion chamber prior to removing a first fuel nozzle assembly from the conventional combustion system; and positioning the flame holder to be at or near the centroid or the terminal end of the flame output by the first fuel nozzle assembly in the conventional combustion system prior to the conventional combustion system being upgraded with the flame holder assembly.

12. The method of claim 1, wherein the refractory body is secured to the support structure opposite to the base and the flame holder is mounted to the support structure spaced from the refractory body between the refractory body and the base.

13. The method of claim 12, wherein the flame holder assembly includes thermal insulation thermally coupled to the support structure at least proximate to the refractory body.

14. The method of claim 1, wherein the flame holder is adjustable between (1) a first position aligned with an opening in the base providing fluid communication between the second fuel nozzle assembly and the flame holder assembly and (2) a retracted second position that is offset from opening in the base.

15. The method of claim 14, wherein the flame holder is configured to hold the start-up flame until the flame holder assembly reaches a predetermined operating temperature and not hold the start-up flame after the flame holder assembly reaches the predetermined operating temperature.

16. The method of claim 1, wherein the refractory body includes at least one of cordierite or mullite.

* * * * *